US005196815A

United States Patent [19]

Chien et al.

[11] Patent Number: 5,196,815

[45] Date of Patent: Mar. 23, 1993

[54] MINIATURE CIRCUIT BREAKER

[75] Inventors: Yun-Ko N. Chien, Murrysville; John J. Shea, Ross Township, Allegheny County; Edmond F. Kowal, Export; John A. Wafer, Brighton Twp., Beaver County, all of Pa.

[73] Assignee: Westinghouse Electric Corp., Pittsburgh, Pa.

[21] Appl. No.: 828,831

[22] Filed: Jan. 31, 1992

[51] Int. Cl.[5] ..... H01H 75/00

[52] U.S. Cl. ..... 335/16; 335/147; 335/35

[58] Field of Search ..... 335/35, 16, 147, 195; 200/147 R

[56] References Cited

U.S. PATENT DOCUMENTS 3,840,833 10/1974 Mrenna et al. .
3,849,747 11/1974 Mrenna et al. .
3,921,109 11/1975 Hodgson .
4,077,025 2/1978 Slade et al. .
4,258,345 3/1981 Malick .
4,266,210 5/1981 Mrenna et al. .
4,276,526 6/1981 Ciarcia et al. .
4,511,774 4/1985 Forsell ..... 200/147 R
4,625,190 11/1986 Wafer et al. .
4,654,490 3/1987 Leone et al. .
4,654,491 3/1987 Maier et al. .
4,654,614 3/1987 Chien et al. .
4,933,653 6/1990 Mrenna et al. .
4,973,805 11/1990 Paton et al. .
5,008,645 4/1991 Mrenna .

*Primary Examiner*—Lincoln Donovan
*Attorney, Agent, or Firm*—M. J. Moran

[57] ABSTRACT

A circuit breaker having a housing, fixed and movable contacts respectively supported by a fixed contact support structure and a movable contact arm, a trip mechanism, and an operating mechanism which is releasably engageable with the trip mechanism. The operating mechanism includes a pivotable operating member and a tension spring. The fixed contact support structure includes a contact supporting leg portion. The movable contact arm has a contact supporting side, and an opposite spring supporting side. The tension spring links the pivotable operating member and the spring supporting side of the movable contact arm. The contact supporting leg portion of the fixed contact support structure and the movable contact arm are disposed in closely spaced relation when the fixed and movable contacts are in engagement, to provide a reverse current loop which magnetically assists in rapid contact separation.

14 Claims, 2 Drawing Sheets

MINIATURE CIRCUIT BREAKER

TECHNICAL FIELD

The invention relates in general to circuit breakers, and more specifically to miniature circuit breakers of the type conventionally utilized in residential, office and light industrial applications.

BACKGROUND ART

Miniature molded case circuit breakers, such as the miniature circuit breaker shown in U.S. Pat. No. 4,266,210, which is assigned to the same assignee as the present application, have a size limitation imposed upon them in order to fit the circuit breakers into panel boards of residential, office and light industrial applications. While the outer dimensions of a miniature circuit breaker are fixed, short circuit current magnitudes available from electrical utilities have increased, requiring the designers of miniature circuit breakers to seek new and improved operating and trip mechanisms which limit the energy let-through expressed by equation $I^2t$, where "I" is the current and "t" is the time from the onset of an overload to arc extinction. To limit energy let-through to an acceptable value, the circuit breaker must provide current limiting, which reduces the "I", and the time from the onset of an overload to arc extinction must be minimized. Thus, the circuit breaker must be extremely fast acting and capable of early contact separation upon the detection of an overload, and an arc voltage must be developed during contact opening which exceeds the driving voltage, to oppose the rise in short circuit current magnitude. In the limited volume available in the cavity of the molded casing, it is difficult to obtain a large contact opening distance, which thus limits the arc voltage obtainable, and it is difficult to obtain a substantial movement of the resulting arc, which is necessary to cool and quickly quench the arc without damage to the components of the circuit breaker. The limited volume available also results in a rapid increase in pressure inside the molded casing during arc interruption. While some pressure build up is beneficial in aiding arc interruption, the maximum pressure must be limited below the point which may damage the circuit breaker. Thus, it would be desirable, and it is an object of the invention, to (1) increase the contact separation distance, (2) increase arc movement, and (3) increase contact opening velocity, to provide a miniature circuit breaker having a significantly increased interruption rating. In addition, the operating mechanism of the circuit breaker must cause the actuating handle of the circuit breaker to remain in the "trip" position, once the movable contact arm crosses a toggle point.

SUMMARY OF THE INVENTION

Briefly, the invention is a miniature circuit breaker which includes an insulative housing, first and second electrical terminals supported by the housing, manually operable actuating means pivotally supported by the housing, and fixed and movable electrical contacts in the housing. An electrically conductive fixed contact support structure supports the fixed contact, and an elongated, electrically conductive movable contact arm supports the movable contact. The movable contact arm is movable between closed and open positions in which the fixed and movable electrical contacts are respectively engaged and separated. The circuit breaker further includes a trip mechanism and an operating mechanism. The trip mechanism includes a bi-metal having a first end electrically connected to the movable contact arm and a second end electrically connected to the second terminal. The operating mechanism includes an operating member pivotally fixed to the housing, and a tension spring. The operating member has a first end releasably engageable with the trip mechanism, and a second end.

The fixed contact support structure includes a leg portion which is electrically connected to the first terminal, and the fixed contact is disposed intermediate the ends of the second leg portion.

The movable contact arm has first and second ends, a contact supporting side, and an opposite spring supporting side. The first end thereof is actuatable by the manually operable actuating means. The movable contact is fixed to the contact supporting side adjacent to the second end.

The tension spring links the second end of the pivotable operating member and the spring supporting side of the movable contact arm.

The leg portion of the fixed contact support structure and the movable contact arm are in closely spaced relation when the fixed and movable contacts are in engagement, to provide a reverse current loop which magnetically aids in rapid separation of the fixed and movable contacts upon the onset of an over current condition. The desired rapid development of high arc voltage and current limiting when an over current condition occurs which results in tripping of the circuit breaker is achieved by an increased contact opening speed.

The operating mechanism of the circuit breaker has been re-arranged and substantially reduced in size, as has the movable contact structure, reducing the inertia of the operating parts. The tension spring of the operating mechanism is located in close proximity to the elongated movable contact arm, with the spring and movable contact arm moving together during operation thereof, while maintaining the close proximity, with their longitudinal axes always being in closely spaced, substantially parallel relation. The operating mechanism, requires only a single operating member, which has one end linked to an end of the tension spring. This single operating member is pivoted on a post integrally formed within the housing cavity, eliminating the need for a separate metallic support plate, with the pivot post being near the actuating means. The tension spring and movable contact arm extend substantially perpendicularly away from the spring supporting end of the operating member, and perpendicularly away from the housing wall which carries the actuating means. The tension spring extends along a side of the movable contact arm which is directly opposite to the side of the contact arm which carries the movable contact, permitting the movable contact arm to be positioned closely adjacent to the fixed contact support leg and thus close to the housing wall which is perpendicular to the housing wall which carries the actuating means. This permits a substantial increase in gap dimension to be achieved between the stationary and movable contacts in the open position of the circuit breaker. As hereinbefore stated, the single operating member extends substantially perpendicularly outward from a position close to an end of the movable contact arm which is adjacent to the actuating means, providing a substantial space within the opening of the angular relationship. Similar to the movable contact arm and tension spring being close to a housing wall when the movable contact arm is in a closed position, the single operating member extends close to the housing wall which carries the actuating means, providing ample space for an integrally molded insulating arc barrier to be disposed between the location of an arc and the location of the trip mechanism and second terminal.

The reduction in component sizes results in an increase in the operating speed of the movable components of the circuit breaker, and the novel construction and arrangement of the stationary and movable contact structures, as well as the operating mechanism, cooperate with the reduced component sizes to increase the volume available within the circuit breaker housing for other circuit breaker functions. For example, the increased volume available permits the increased contact separation distance, an increased arc chute volume, and room for stretching and moving an arc between the movable contact and a first arc runner. It also enables the arc to be transferred from the movable contact structure, near or at the end of the movable contact travel, from an arcing tip at the end of the movable contact support arm to a second arc runner. The first and second arc runners lead the arc into the increased volume arc chute. The increased volume available within the housing also reduces the chance that destructive pressures will be produced within the molded case or housing during arc interruption, and ample vent openings in the molded housing at the exit end of the arc chute quickly exhaust gases and other by-products of arc extinction. The increased volume available also enables the molded arc barrier to be integrally formed within the housing cavity in a position which separates an arc from the trip mechanism and load terminal, while still permitting room for a substantial reverse current loop to be formed between the stationary and movable contact arms, which magnetically assists contact separation.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
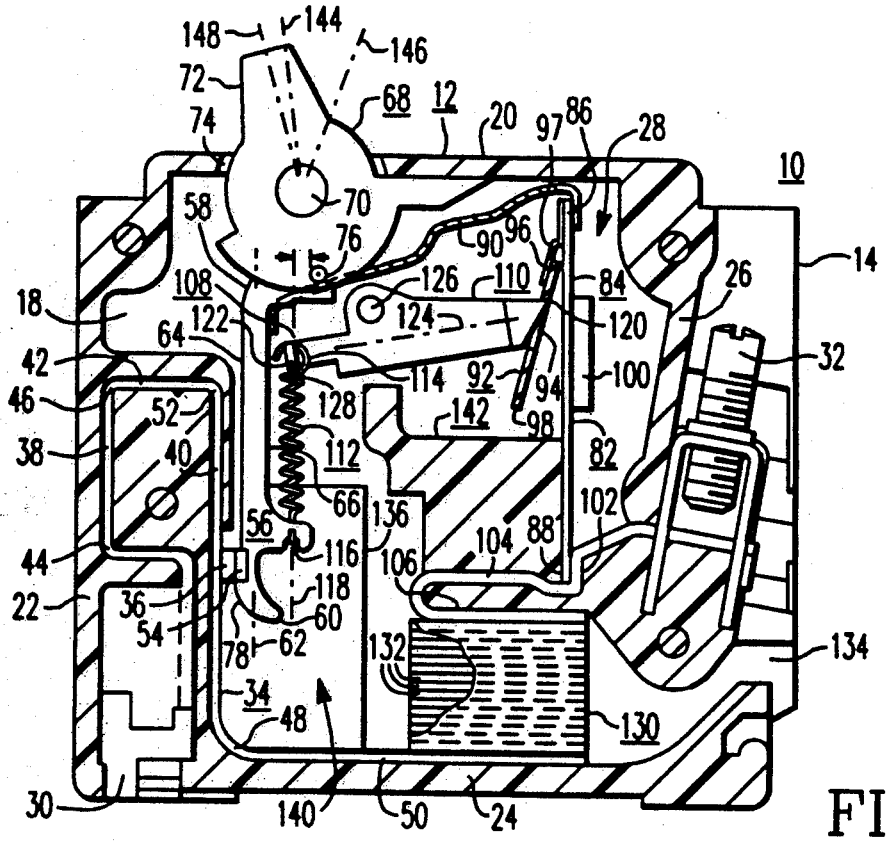
FIG. 1 is a side elevational view of a miniature circuit breaker constructed according to a first embodiment of the invention, with a housing cover removed, and with some parts shown in section, illustrating the circuit breaker in a closed position.
Figure 2:
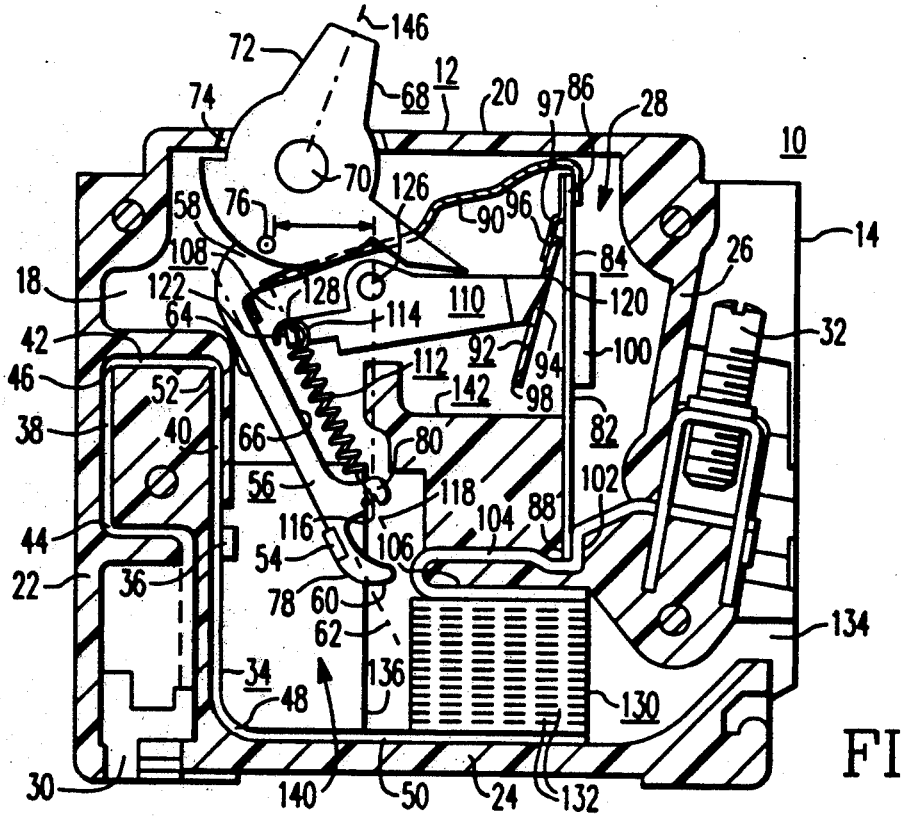
FIG. 2 is a side elevational view of the miniature circuit breaker shown in FIG. 1, except in an open, reset position.
Figure 3:
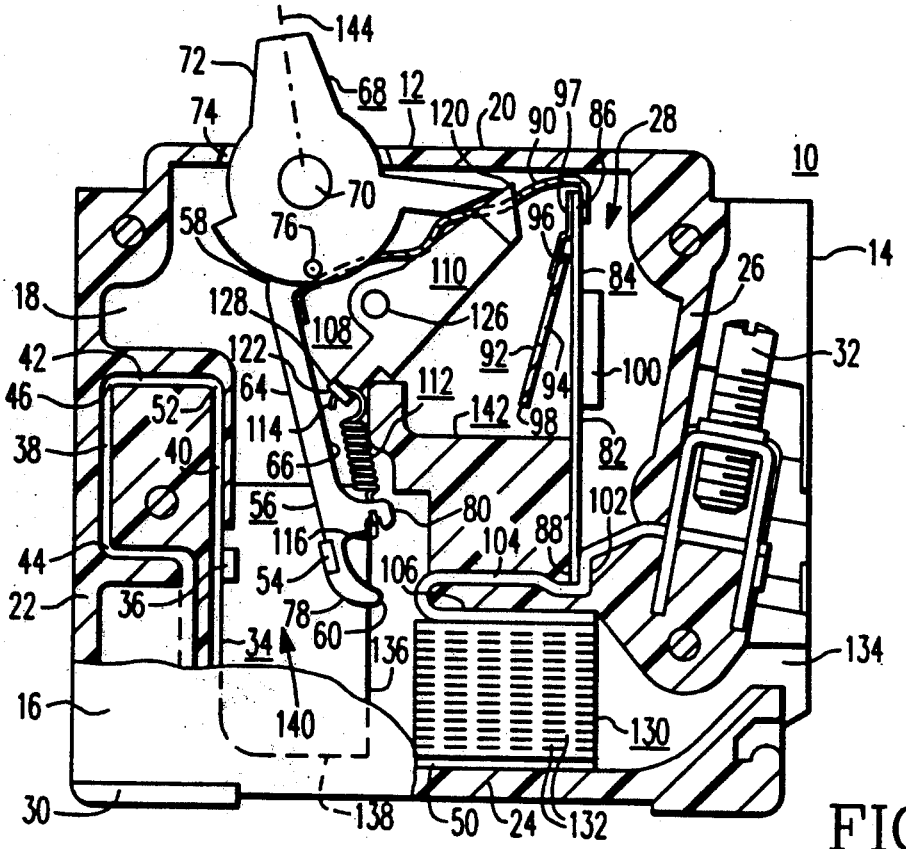
FIG. 3 is a side elevational view of the miniature circuit breaker shown in FIGS. 1 and 2, except in a tripped position.

Referring now to the drawings, a first embodiment of the invention is set forth in FIGS. 1, 2 and 3, which illustrate side elevational views of a miniature molded case circuit breaker 10 in closed, open and trip positions, respectively. Circuit breaker 10 includes a molded insulative housing or casing 12 having a main body portion or base member 14 and a cover 16, which are formed of a good electrical insulation, such as glass polyester, or black urea. The cover 16 is removed from main body portion 14 in FIGS. 1 and 2, and it is shown only in fragmentary form in FIG. 3, and some parts of the main body portion 14 are shown in section, in order to clearly illustrate the operating components of circuit breaker 10.

Main body portion 14 includes a flat side wall portion 18 and first, second, third and fourth upstanding perimetric housing wall portions 20, 22, 24 and 26, respectively, all of which cooperatively define a cavity 28. First and second electrical terminals 30 and 32 are seated in the main body portion 14, with terminals 30 and 32 being formed of a good electrical conductor, such as copper or brass.

An electrically conductive fixed contact structure 34 supports a fixed electrical contact 36. Fixed contact structure 34, which is placed close to, or embedded within the second housing wall portion 22, is in the form of a loop, in this first embodiment of the invention, with the fixed contact loop having first and second spaced leg portions 38 and 40, respectively, and a connecting bight 42. The first leg portion 38 has a first end 44 connected to the first electrical terminal 30, and a second end 46 connected to bight 42. The second leg portion 40 has a first end 48 which, in a preferred embodiment of the invention, is connected to a first arc runner 50, and a second end 52 which is connected to bight 42. The first arc runner 50, which is preferably an integral extension of the fixed contact structure 34, extends perpendicularly outward from the first end 48 of the second leg portion 40, with the first arc runner 50 being placed against the third housing wall 24 of main body portion 14. The fixed contact 36 is brazed, or otherwise firmly attached, to the second leg portion 40, intermediate the first and second ends 48 and 52.

Figure 4:
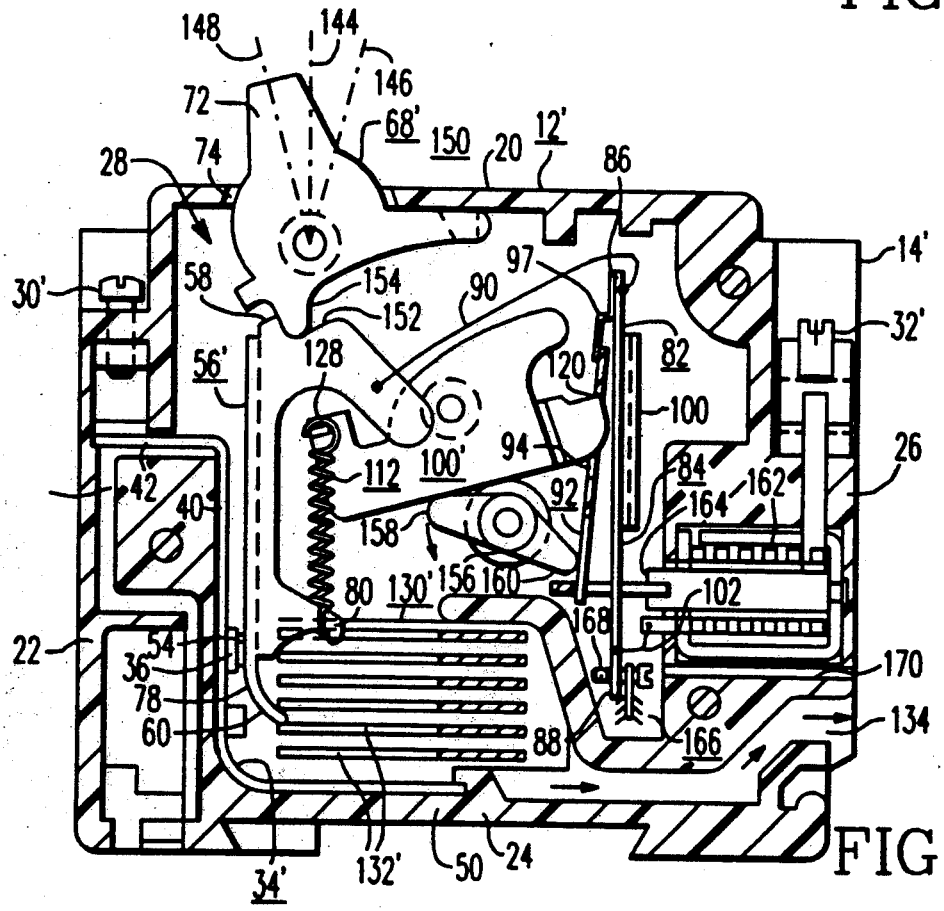
FIG. 4 is a side elevational view of a miniature circuit breaker constructed according to a second embodiment of the invention, including a magnetic coil for enhanced sensitivity to lower over-current conditions.

Fixed contact 36 cooperates with a movable contact 54 which is carried by an elongated electrically conductive movable contact arm 56. Movable contact arm 56 has first and second ends 58 and 60, respectively, a longitudinal axis 62 which extends between ends 58 and 60, and first and second major, flat opposed sides 64 and 66, respectively. The first end 58 of movable contact arm 56 is pivotally related to a manually operable actuating means 68, which will hereinafter be called operating handle 68. Operating handle 68 is pivotally supported by housing 12, via a pivot pin 70, with operating handle 68 being close to the first housing wall 20, and having a manually actuatable portion 72 which extends through an opening 74 in housing wall 20. The pivotal relation of the first end 58 of movable contact arm 56 may be in the form of a pivot pin 76, as shown in FIGS. 1, 2 and 3; or, as shown in the embodiment of FIG. 4, movable contact arm 56 may be pivoted on an integral extension 154 of the operating handle 68.

The movable contact 54 is brazed, or otherwise suitably attached, to the first side 64 of movable contact arm 56, which is thus the contact supporting side of movable contact arm 56. The movable contact 54 is located near the second end of contact arm 56, but is spaced therefrom by a predetermined dimension to provide an arc runner surface 78 between movable contact 54 and the second end 60. A hook 80 is attached to, or integrally formed with, the second side 66 of contact arm 56, with hook 80 being located near movable contact 54, but on the opposite side of the contact arm from movable contact 54.

A trip mechanism 82, which may be conventional, such as the trip mechanism shown in the hereinbefore mentioned U.S. Pat. No. 4,266,210, includes a bi-metal 84 having first and second ends 86 and 88, respectively. The first end 86, which is free to move when the temperature of bi-metal 84 increases due to current flow therethrough, is electrically connected to the first end 58 of movable contact arm 56 via a flexible conductor 90. The second end 88 of bi-metal 84 is electrically connected to the second terminal 32, with the second end being permanently fixed, as illustrated in the embodiment of FIGS. 1, 2 and 3, or adjustably fixed, as will be hereinafter explained relative to the embodiment of FIG. 4. A ferromagnetic armature 92, having an opening 94, has a first end 96 fixed to the first end of bi-metal 84 via a leaf spring 97 and a second end 98 which extends outwardly from bi-metal 84 at a predetermined angle. A ferro-magnetic member 100 is fixed to bi-metal 84 in alignment with magnetic armature 92. Thus, bi-metal 84 may bend in a clockwise direction, when viewing the Figures, due to a temperature rise thereof caused by current flow, such as caused by a sustained overload current, which will move magnetic armature 92 along with it. Magnetic armature 92 is also free to deflect in a counter-clockwise direction, via leaf spring 97, due to attraction of armature 92 to magnetic member 100 when currents of short circuit magnitude flow through bi-metal 84. Either condition results in tripping circuit breaker 10, with the former condition tripping the circuit breaker 10 if the overload persists, and with the latter condition resulting in an instantaneous trip.

The means for electrically connecting the second end 88 of bi-metal 84 to the second electrical terminal 32 includes a conductor 102. In a preferred embodiment of the invention, conductor 102 includes an extension 104 which functions as a second arc runner, with the second arc runner 104 having a leg portion 106 which is disposed in spaced parallel relation with the first arc runner 50.

Circuit breaker 10 includes an operating mechanism 108 which includes a single operating member 110 and a tension spring 112. Tension spring 112 has first and second ends 114 and 116, respectively, and a longitudinal axis 118 which extends between its ends. The single operating member 110 is an elongated member having first and second ends 120 and 122, and a longitudinal axis 124 which extends between its ends. In a preferred embodiment of the invention, in order to eliminate the need for a costly metallic mounting plate, a pivot post 126 is integrally formed with side wall portion 18, and the single operating member 110 is pivotally mounted on pivot post 126, at a location intermediate its first and second ends 120 and 122. The first end 120 of operating member 110 is formed to engage opening 94 in armature 92, and the second end 122 of operating member 110 includes a hook 128. Tension spring 112 is disposed to link hooks 80 and 128 with its ends 116 and 114, respectively.

The increased contact speed and large contact opening dimension achievable by circuit breaker 10 provide an interrupting rating suitable for many applications. The increased volume available in cavity 28 provides space for an optional large volume arc chute assembly 130 which gives circuit breaker 10 an even higher interrupting capability. Arc chute assembly 130, which includes a plurality of closely spaced metallic arc chute plate members 132 of conventional construction, is disposed adjacent to the third housing wall 24 of housing body portion 14, between the spaced first and second arc runners 50 and 106. Housing body portion 14 includes one or more vent openings, such as vent opening 134, which quickly vents gases and other arcing produced by-products from the exit side of arc chute assembly 130 to the outside of housing 12, which enhances interruption and prevents peak housing pressure during arc interruption from exceeding unsafe levels.

Since the intense heat of an arc can ablate the adjacent portions of side wall 18 and cover 16, in a preferred embodiment of the invention, protective plate members 136 and 138 are secured against side wall 18 and cover 16, on opposite sides of an arc chamber 140 located between the stationary contact 36 and the entrance side of arc chute assembly 130. Protective plate members 136 and 138 are preferably formed of a ceramic, such as a ceramic composition which may include alumina trihydrate, for example.

The compact operating mechanism 108 and contact structure provide ample room in cavity 28 for an integrally molded arc barrier 142. Arc barrier 142 extends from side wall 18 to the inside surface of cover 16, at a substantially central location within cavity 28 selected to maintain an arc within arc chamber 140. Arc barrier 142 reduces the chance of conduction from fixed contact structure 34 to the trip mechanism 82 via plasma formed during arc interruption.

When circuit breaker 10 is in the tripped configuration shown in FIG. 3, the actuating portion 72 of operating handle 68 will have the orientation indicated by broken line 144. Moving actuating portion 72 to the orientation indicated by broken line 146 in FIG. 2 will cause end 120 of operating member 110 to engage a wall of opening 94, to latch or reset the breaker, and then moving actuating portion 72 to the orientation indicated by broken line 148 in FIG. 1 will move the moveable contact arm 56 to the closed or contact engaging position.

In the closed position of circuit breaker 10 shown in FIG. 1, the spring force exerted by spring 112 is substantially vertically oriented, passing on the left-hand side of pivot pin 76 as indicated by dimension 147 in FIG. 1. The direction of spring force, which is aligned with spring axis 118, has a relatively small moment arm measured perpendicularly from the line of force to the pivot pin 76. This provides a contact closing bias, i.e., a spring force on movable contact arm 56 which tends to pivot contact arm 56 in a clockwise direction about pivot pin 76. This arrangement provides an adequate contact closing force without creating an excessive clockwise force on contact arm 56, facilitating a quicker movement of contact arm 56 towards the open position when circuit breaker 10 is tripped, and a high rate of change of velocity, or acceleration, away from the closed position, which results in excellent current limiting.

As actuating handle 68 is moved from the FIG. 1 position to the open position of FIG. 2, the location of pivot pin 76 and the orientation of spring 112 are both changed, such that the spring force on movable contact arm 56 has a large vertical component which is now directed on the right-hand side of pivot pin 76 as indicated by dimension 149 in FIG. 2. The large vertical force component has a much larger moment arm than in FIG. 1, and being on the right-hand side of pivot pin 76, provides a counter clockwise force on movable contact arm which greatly exceeds the clockwise force caused by the small horizontal spring force component, maintaining movable contact arm 56 in the open position.

When circuit breaker 10 is tripped, i.e., when end 120 of operating member 110 is released from opening 94 in armature 92, the initial dissipation of spring force, quickly pivots operating member 110 counter clockwise about its pivot post 126, while simultaneously shifting the orientation of the spring force from the vertical position of FIG. 1 towards the angled position of FIG. 2. This instantly produces a vertical force component which is directed past the right-hand side of pivot pin 76, providing a resultant force on movable contact arm 56 which, along with a magnetic repulsion force produced between stationary leg 40 and movable contact arm 56 during a trip condition, quickly and rapidly moves the low inertial movable contact arm 56 to the open, tripped position shown in FIG. 3.

More specifically, when the fixed and movable contacts 36 and 54 are engaged, a current path is established between the first and second terminals 30 and 32 which includes leg portion 38, bight 42, leg portion 40, movable contact arm 56, flexible conductor 90, bi-metal 84, and conductor 102. It will be noted that leg 40 of the stationary or fixed contact structure 34 is amply spaced from the other leg portion 38 of the fixed current loop, to reduce magnetic repulsion forces therebetween, while leg 40 of the fixed contact structure 34 is in close proximity to the elongated movable contact arm 56. Thus, upon the onset of a short circuit condition, armature 92 will be drawn towards magnetic member 100, releasing the latched operating member 110 to initiate tripping of circuit breaker 10, and the oppositely flowing short circuit current flowing through leg 40 and movable contact arm 56 provides a reverse current loop which develops a magnetic repulsion force which pivots movable contact arm 56 to the open position shown in FIG. 2 much more rapidly than possible by tension spring 112 acting alone.

Movable contact arm 56 has very low inertia, and the long radius from pivot pin 76 to movable contact 54 also aids a very rapid movement of movable contact 54 away from the fixed contact 36. An arc initially drawn between the fixed and movable contacts 36 and 54 will quickly move away from the fixed contact 36 and out on the first arc runner, and it will quickly move away from the movable contact 54 and out on to the arcing surface 78. This reduces contact erosion and extends the useful operating life of circuit breaker 10. As the movable contact arm 56 continues to open, an arc will continue to move rapidly, running along the first arc runner, stretching and cooling it between the ceramic plates 136 and 138. When the second end 60 of the movable contact arm 56 reaches the fully open position shown in FIG. 2, the arc transfers to the second arc runner 106.

The disclosed construction of arc runner assembly, which includes arc runners 50 and 106, drives the arc into the large volume arc chute assembly 130, which may include a plurality of closely spaced, metallic arc splitter plate members 132. The arc splitter plate members 132 provide an increased interrupting capability by further cooling and splitting the arc into small segments, all of which quickly builds an arc voltage which opposes the driving voltage to provide highly effective current limiting.

The rapid separation of the contacts, coupled with the arc stretching, cooling, arc splitting, and ample venting, limit the time from the onset of the short circuit condition to arc extinction, providing a very low $I^2t$, or energy let-through. Plasma formed during the arc extinction process is confined to the arc chamber 140 by the strategically located arc barrier 142, directing gases and arcing by-products through the arc chute assembly 130 and out of the housing 12 via the ample venting path 134.

The significantly increased usable volume within cavity 28, which enables the large, highly effective reverse current loop to be formed, is made possible by placement of tension spring 112 on the opposite side of the movable contact arm 56 from the movable contact 54, and by an arrangement which places the tension spring 112 closely adjacent to the elongated movable contact arm 56. It will be noted that in all three configurations of circuit breaker 10 shown in FIGS. 1, 2 and 3, that the longitudinal axes 62 and 118 of the movable contact arm 56 and tension spring 112 are always in substantially the same closely spaced parallel relation.

The space saving construction is further enhanced by the use of a single operating member 110 which occupies only a small portion of the cavity volume near actuating member 68 and the first housing wall 20 of housing body portion 14. The longitudinal axis 124 of the single operating member 110 is substantially perpendicular to the longitudinal axes 62 and 118 of movable contact arm and tension spring 112, in the closed position of circuit breaker 10 shown in FIG. 1, being slightly in excess of 90 degrees. This space saving 90 degree arrangement intersects the movable contact arm 56 near its first end 58, and the angular relationship reduces to an angle only slightly less than 90 degrees in the reset position of FIG. 2. The angular relationship increases significantly beyond 90 degrees in the tripped position of FIG. 3, with all three angular configurations requiring very little operating space. Thus, ample volume is provided for the large reverse current loop, the large contact opening, the large volume arc chute assembly 130, a large arcing chamber 140, and a substantial arc barrier 142.

FIG. 4 is a side elevational view of a circuit breaker 150 which utilizes the principles of the invention set forth in the embodiment of FIGS. 1, 2 and 3, and additionally sets forth additional features which may be used, in addition to, or in place of, those shown in the first embodiment, in the domestic market, as well as in the European market. Components and functions of circuit breaker 150 which are similar to those already described are identified with like reference numerals, and will not be described again in detail. Modified components will be identified with the numerals of the first embodiment, with the addition of a prime mark.

Housing 12' has been modified slightly to accommodate a slightly different placement of first and second electrical terminals 30' and 32'. A fixed contact structure 34' of this embodiment of the invention does not require a loop because of the different placement of the first terminal 30', to which it is connected. The bight 42, minus the first leg 38, is directly connected to terminal 30'.

The movable contact arm 56', instead of being pinned to actuating handle 68', is pivotally related to actuating handle 68' via a depression 152 at its first end 58 and a projection 154 on the operating handle 68' which rides in depression 152. The need for the second arc runner 106 is eliminated by opening the movable contact 54 directly into an opening defined by an arc chute assembly 130', moving the movable contact 54 and the second end 60 of movable contact arm 56' through a cavity formed by the configuration of arc splitter plate members 132'.

Simultaneous operation of two or more circuit breakers 150 disposed in a ganged relationship is provided by a pivotally mounted lever 156 which is rotatable by adjacent circuit breakers. Lever 156 has a first end 158 which is actuated by movement of operating member 110', and a second end 160 which actuates armature 92 to trip the circuit breaker. Thus, the tripping of a first circuit breaker 150 will rotate lever 156, translating the tripping of the first circuit breaker 150 to tripping of the ganged circuit breakers.

Instead of connecting bi-metal 84 directly to the second terminal 32', an electromagnetic coil 162 is connected between the bi-metal 84 and terminal 32'. Coil 162 has a movable core member 164 linked to armature 92. Coil 162 will make circuit breaker 150 more sensitive to lower over-load current magnitudes than possible by magnetic member 100 operating alone. Upon reaching a predetermined over-load current magnitude flowing through coil 162, core 164 will move into coil 162 sufficiently to move armature 92 and disengage end 120 of operating member 110' from opening 94, to trip circuit breaker 150.

The second end 88 of bi-metal 84 may be fixed, as in the first embodiment, or, as illustrated in FIG. 4, it may be adjustably fixed via adjusting means 166, which permits easy calibration of circuit breaker 150. Adjusting means 166, for example, may include a captive screw 168, upon which bi-metal 84 is threadably engaged, with the actuating end of screw 168 being aligned with a sealable opening 170 formed in housing portion 14'. Thus, circuit breaker 150 may be calibrated after complete assembly thereof, including placement of cover 16 on body portion 14. Circuit breaker 150 has the same increased interrupting capability as circuit breaker 10, for the reasons hereinbefore set forth relative to circuit breaker 10.

We claim:

1. A miniature circuit breaker comprising an insulative housing, first and second electrical terminals supported by said housing, manually operable actuating means pivotally supported by said housing, fixed and movable electrical contacts in said housing, an electrically conductive fixed contact support structure supporting said fixed contact, with the fixed contact support structure being electrically connected to the first terminal, an elongated, electrically conductive, movable contact arm supporting said movable contact, and being movable between closed and open positions in which the fixed and movable electrical contacts are respectively engaged and separated, a trip mechanism which includes a bi-metal having a first end electrically connected to the movable contact arm and a second end electrically connected to said second terminal, and an operating mechanism comprising an operating member pivotally fixed to the housing, and a tension spring having first and second ends and a longitudinal axis therebetween, with said operating member having first and second ends and a longitudinal axis therebetween, with the first end being releasably engageable with said trip mechanism, the improvement comprising:

said movable contact arm having first and second ends, a contact support side, and an opposite spring supporting side, with the first end of said movable contact arm being actuatable by the manually operable actuating means and with the movable contact being fixed to the contact supporting side adjacent to the second end of said movable contact arm, the second end of said pivotable operating member being adjacent to and spaced from the spring supporting side of said movable contact arm, in both the engaged and separated positions of the fixed and movable contacts, the first and second ends of said tension spring respectively linking the second end of said pivotable operating member and the spring supporting side of said movable contact arm, with said longitudinal axes of the tension spring and movable contact arm being in spaced, substantially parallel relation in both the engaged and separated positions of the fixed and movable electrical contacts, and wherein the fixed contact support structure includes a contact supporting leg portion which is in closely spaced relation with the movable contact arm, when the fixed and movable contacts are in engagement, to provide a reverse current loop which magnetically aids in rapidly separating the fixed and movable contacts upon the onset of an over current condition.

2. The circuit breaker of claim 1 including an electrically conductive member which extends substantially perpendicularly outward from the contact supporting leg portion of the fixed contact support structure to function as a first arc runner which moves and stretches an arc drawn between the fixed and movable contacts when they separate.

3. The circuit breaker of claim 2 including a second arc runner disposed in parallel spaced relation with the first arc runner, with the second end of the movable contact arm being in close proximity to the second arc runner when the fixed and movable contacts separate, to transfer an arc from the movable contact arm to the second arc runner, and including an arc chute assembly disposed between the first and second arc runners.

4. The circuit breaker of claim 3 including an opening in the housing adjacent to the arc chute assembly which vents gases formed during interruption of an arc in the arc chute assembly.

5. The circuit breaker of claim 3 wherein the housing includes electrically insulative barrier means integrally formed therewith disposed between the movable contact arm and the trip mechanism, with said barrier means aiding in directing an arc into the arc chute assembly.

6. The circuit breaker of claim 1 including an electromagnetic coil electrically connected between the second end of the bi-metal and the second electrical terminal, and a movable core disposed in said coil linked to the trip mechanism.

7. The circuit breaker of claim 1 including a post integrally formed with the housing, with the pivotable operating member of the operating mechanism being mounted for pivotable movement on said integrally formed post.

8. The circuit breaker of claim 1 wherein the housing includes a base member and a cover, and including first and second ceramic plate members respectively fixed to said base member and cover, on opposite sides of the location where an arc is formed between the fixed and movable contacts when the contacts separate under load.

9. The circuit breaker of claim 1 including a sealable opening in the housing, and adjusting means for adjusting the position of a predetermined end of the bi-metal, with said sealable opening in the housing being aligned with said adjusting means, enabling the circuit breaker to be calibrated after assembly via a tool insertable through said sealable opening.

10. The circuit breaker of claim 1 wherein the housing has first, second, third and fourth outer sides which cooperatively define a cavity, with the actuating means being pivotally supported by said first side, the fixed contact structure extending along the second side which is perpendicular to said first side, the movable contact arm and tension spring also being closely adjacent to said second side when the movable contact am is in the closed position thereof, and with the operating member extending along the first side, adjacent to the actuating means, such that a longitudinal axis of the operating member is substantially perpendicular to the substantially parallel longitudinal axes of the movable contact arm and the tension spring, when the movable contact arm is in the closed position thereof.

11. The circuit breaker of claim 11 including an electrically conductive member which extends substantially perpendicularly outward from the contact supporting leg portion of the fixed contact support structure, along the third side of the housing, to function as a first arc runner, a second arc runner spaced from the first arc runner, and including an arc chute assembly disposed within the cavity, adjacent to the third side of the housing, between the first and second arc runners.

12. The circuit breaker of claim 11 wherein the trip mechanism is disposed within the cavity, adjacent to the fourth side of the housing.

13. The circuit breaker of claim 1 wherein the fixed contact support structure defines a loop having first and second spaced leg portions each having first and second ends, and a bight portion interconnecting said second ends, with the first end of the first leg portion being electrically connected to the first electrical terminal, and with the second leg portion functioning as the contact supporting leg portion, with the fixed contact being disposed intermediate the first and second ends of said second leg portion, and wherein the second leg portion of the fixed contact support structure and the movable contact arm are spaced closer together than the first and second leg portions of the fixed contact support structure when the fixed and movable contacts are in engagement.

14. The circuit breaker of claim 1 wherein the movable contact arm is pivotally related to the manually operable actuating means via a predetermined pivot axis, with the tension spring providing an effective force having a first moment arm about said pivot axis in the contact closing direction, when the fixed and movable contacts are closed, and an effective force having a second and longer moment arm about said pivot axis when the circuit breaker is tripped, providing a larger force in the contact opening direction during tripping than is provided in the contact closing direction when the circuit breaker is closed.

* * * * *